US011329357B1

(12) United States Patent
Geiler

(10) Patent No.: US 11,329,357 B1
(45) Date of Patent: May 10, 2022

(54) PASSIVE THERMAL STABILIZATION OF SELF-BIASED JUNCTION CIRCULATORS AND RELATED CIRCUITS AND TECHNIQUES

(71) Applicant: Metamagnetics, Inc., Westborough, MA (US)

(72) Inventor: Michael Geiler, Boston, MA (US)

(73) Assignee: Metamagnetics, Inc., Westborough, MA (US)

( * ) Notice: Subject to any disclaimer, the term of this patent is extended or adjusted under 35 U.S.C. 154(b) by 0 days.

(21) Appl. No.: 16/868,967

(22) Filed: May 7, 2020

Related U.S. Application Data

(60) Provisional application No. 62/844,326, filed on May 7, 2019.

(51) Int. Cl.
*H01P 1/387* (2006.01)

(52) U.S. Cl.
CPC ..... *H01P 1/387* (2013.01)

(58) Field of Classification Search
CPC ..... H01P 1/32; H01P 1/36; H01P 1/38; H01P 1/387
USPC ..... 333/1.1, 24.2
See application file for complete search history.

(56) References Cited

U.S. PATENT DOCUMENTS

| | | | | |
|---|---|---|---|---|
| 7,256,661 | B2 | 8/2007 | Chen et al. | |
| 7,495,521 | B2 | 2/2009 | Chen et al. | |
| 8,704,608 | B1 | 4/2014 | Chen et al. | |
| 9,172,145 | B2 | 10/2015 | Puzella et al. | |
| 2009/0002090 | A1* | 1/2009 | Pietig | H01P 1/38 333/24.2 |
| 2011/0193649 | A1* | 8/2011 | Popelka | H01P 1/387 333/1.1 |

OTHER PUBLICATIONS

Oliver, et al.; "Integrated Self-Biased Hexaferrite Microstrip Circulators for Millimeter-Wavelength Application"; IEEE Transactions on Microwave theory and Techniques; vol. 49; No. 2; pp. 385-387; Feb. 2001; 3 Pages.

* cited by examiner

*Primary Examiner* — Stephen E. Jones
(74) *Attorney, Agent, or Firm* — Daly, Crowley, Mofford & Durkee LLP

(57) ABSTRACT

Described is a self-biased circulator which includes an active layer disposed between an RF ground plane and a circulator junction circuit. The RF ground plane is disposed between the active layer and a compensating layer. The active layer and compensating layer are used in combination to reduce variation of the internal magnetic field in the circulator over temperature.

20 Claims, 2 Drawing Sheets

PASSIVE THERMAL STABILIZATION OF SELF-BIASED JUNCTION CIRCULATORS AND RELATED CIRCUITS AND TECHNIQUES

CROSS-REFERENCE TO RELATED APPLICATIONS

This application claims the benefit of U.S. provisional application No. 62/844,326, filed on May 7, 2019 which application is hereby incorporated herein by reference in its entirety.

BACKGROUND

As is known in the art, self-biased circulators do not require external permanent magnets for operation. For the case of many junction circulators, self-biased properties are a result of the characteristics of the materials on which the metal junction circuit is printed or placed in intimate contact with. Thus, the non-reciprocal behavior of the circulators depends solely upon material properties and not upon magnetic fields provided by external permanent magnets.

Self-biased circulators are desirable because they allow for greater electronic integration and miniaturization of the circulator than is possible with conventional devices which require external biasing magnets.

SUMMARY

In accordance with the concepts described herein, it has been recognized that since the non-reciprocal behavior of the circulators depends solely upon material properties and not upon magnetic fields provided by external permanent magnets, the dependence of the self-biased material properties with temperature have a significant effect on device performance. In particular, an upward shift of temperature results in an upward shift in the operating frequency, while a downward shift in temperature results in a downward shift in the operating frequency. This effect may be pronounced in self-biased circulators because of the influence of a ferrite anisotropy field, which is not present in conventionally biased circulators (i.e. circulators biased using external permanent magnets).

To facilitate electronic integration and miniaturization of self-biased circulators, it is desirable to use thin ferrite layers in circulators. The use of thin layers is attractive because monolithic microwave integrated circuits (MMIC) use thin layers, and integration with MMICs is a sought-after objective. Use of thin ferrite layers in self-biased circulators, however, exacerbates the effects of thermal variation on electrical performance self-biased circulators.

It has also been recognized that temperature variations negatively impact operational characteristics of self-biased circulators comprising ferrite structures having a high diameter-to-thickness ratio. For example, in self-biased circulators having diameter-to-thickness ratios in the range of 4:1 to 10:1 or greater) temperature variations may negatively impact operational characteristics of the self-biased circulator. The diameter-to-thickness ratio of the ferrite structure corresponds to a permeance coefficient ($P_c$) and load line which are known in static magnetic theory to result in a limitation on the exposure temperature of the material below which permanent demagnetization may occur (e.g. a minimum exposure temperature).

When the intrinsic magnetization curve of a permanent magnet passes through the load line, the permanent magnet experiences partial demagnetization. The degree of demagnetization depends upon how far below the temperature limit the magnet is brought.

Described herein are concepts, circuits, devices and techniques which reduce (and ideally minimize) to a practical point the effects of temperature variation on self-biased circulator performance. The concepts, circuits, devices and techniques described herein are particularly useful when the self-biased circulator design calls for signal to ground spacings (i.e., the distance between the signal conductor and ground conductor which may often correspond to the substrate thickness) and/or substrate thicknesses suitable for use with MMICs. In some embodiments, it may be preferable to utilize a substrate having a thickness less than 20 mils (e.g., a thickness for use in microelectronics/PCB applications). In some embodiments (e.g. for use in MMIC applications), a substrate may be provided having a thickness in the range of about 2-to about 4 mils (0.002" to 0.004").

The concepts, circuits, devices and techniques described herein allow for applying ferrite RF/Microwave structures having a diameter-to-thickness ratio in the range of 8:1 to 20:1, a demagnetizing factor ($N=N_x-N_z$) in the range of 0.77 to 0.88, and permeance coefficient in the range of 0.30 to 0.14 in designs (or devices) with storage temperatures as low as −55 degrees Celsius or lower.

In some embodiments, two layers of hexaferrite may be used in combination to reduce (and ideally, minimize) variation of the internal magnetic field in the ferrite over temperature. In embodiments, there could be more than two layers. In embodiments, one or more layers may be provided from other magnetic materials (i.e. other than a ferrite or hexaferrite) for additional compensation or tuning.

In some embodiments, two or more layers of any material having magnetic properties similar to a permanent magnet material may be used in combination to reduce (and ideally, minimize) variation of the internal magnetic field over temperature.

One layer is referred to as the "active" layer, while the other is referred to as the "compensating" layer. The active layer may be constructed or otherwise provided as a microstrip or stripline circulator, (e.g., a substrate disposed between an RF ground plane and a signal trace circuit). RF vias may be fabricated or otherwise provided in the active layer to electrically couple the RF ground plane to the top side of the circuit (i.e., to provide an electrical connection between the ground plane and the top side of the active layer) to facilitate a ground-signal-ground (GSG) topside interconnection interface. Alternatively, in a stripline configuration the signal trace could be brought down to the ground plane level using RF vias to facilitate a surface mount (SMT) interconnect and the compensating layer could be placed above the upper ground plane of the stripline device.

The compensating layer is placed or otherwise disposed on the opposite side of the RF ground plane, away from the active layer and signal trace circuit. In the case of a microstrip circuit, for example, the compensating layer can be placed below the RF ground plane. For a stripline circuit, the compensating layer could be placed above and/or below the ground planes. If the compensating layer is placed below the active layer in either microstrip or stripline configurations, it may be necessary to provide an electrical connection between the ground plane on the bottom of the active layer and the RF ground of the remaining circuit or application in which the device is used. This can be achieved using vias in the compensating layer, or other forms of interlayer interconnects.

The thickness of the compensating layer is chosen through a combination of modelling of static magnetic material properties and experimentation. The thickness may also be determined entirely in an empirical fashion. One design goal is to increase (and ideally maximize) the permeance coefficient and reduce (and ideally minimize) the temperature effects of drift of the circulator frequency with temperature. This arrangement of active layer, compensating later and RF ground plane results in a self-biased junction circulator having a passive thermal stabilization characteristic. That is thermal stabilization is achieved in the junction circulator without actively controlling magnetic fields (e.g. without actively controlling external magnetic fields).

In embodiments, the compensating layer results in changes in a demagnetization factor. In embodiments, the compensating layer results in changes in an applied external field. In embodiments, the compensating layer results in changes in both a demagnetization factor and an applied external field which may lead to an increased internal field (i.e., increased compared to the same active ferrite layer without any compensating layer beneath it) at room temperature (e.g., a temperature in the range of about 60-85 degrees Fahrenheit) along with the corresponding increase in the operating frequency. The design of the circulator accounts for the changes of the internal field due to the compensating layer. It should be appreciated that, in terms of magnetic circuits, the standalone ferrite layer is known as being in "open circuit configuration." Adding additional layers is building a circuit and adding the extra material below the active layer results in an overall higher field in the ferrite because of the lower demagnetizing field and factor.

In embodiments, the circulator is designed to operate under the "compensated" internal magnetic field.

By inserting the compensating layer below the active layer's ground plane, a demagnetizing factor N parameter is reduced. The thicker the compensating layer, the lower N can become. Reducing N has at least the following effects: (1) at room temperature: for a given material, the internal field increases because N is reduced (and ideally minimized); (2) in the range of +25 to +150 degrees Celsius: because the magnetic moment (Mr) reduces, the internal field increases, but the increase of the internal field is limited by the fact that the demagnetizing factor N is reduced (and ideally, minimized); (3) in the range of −55 to +25 degrees Celsius: since the magnetic moment Mr increases, the internal field decreases, but the decrease of the internal field is limited by the fact that the demagnetizing factor N is reduced (and ideally, minimized).

The concepts, circuits and devices described herein enable thin active layers used in circulator devices to be exposed to very low storage temperature, that would otherwise cause permanent demagnetization damage to the device. Since the compensating layer changes the N parameter, it also changes the $P_c$ parameter. With a higher $P_c$ the device can be exposed to lower storage temperatures without experiencing permanent demagnetization.

The concepts, circuits and devices described herein do not affect the magneto-crystalline anisotropy field in any known way.

The concepts, circuits and devices described herein can be applied to microstrip, stripline or coplanar waveguide circuits.

In the case of the microstrip circuit, the compensating layer can be placed below the RF ground plane.

In the case of stripline circuits, the compensating layer could be placed above and/or below the ground planes.

The circulator junction circuit can be provided having a circular shape, a triangular shape, or any regular or irregular circulator junction shape.

In embodiments, the self-biased circulator may comprise a radiation shield disposed to reduce and ideally minimize losses. The radiation shield may be comprised of an electrically conductive material, which may be electrically coupled to the RF ground plane and disposed above the circulator junction circuit. Stripline embodiments are provided having a natural radiation shield, so an external radiation shield may serve to provide additional radiation shield characteristics.

BRIEF DESCRIPTION OF THE DRAWINGS

The manner and process of making and using the disclosed embodiments may be appreciated by reference to the figures of the accompanying drawings. It should be appreciated that the components and structures illustrated in the figures are not necessarily to scale, emphasis instead being placed upon illustrating the principals of the concepts described herein. Like reference numerals designate corresponding parts throughout the different views. Furthermore, embodiments are illustrated by way of example and not limitation in the figures, in which.

DETAILED DESCRIPTION

Figure 1:
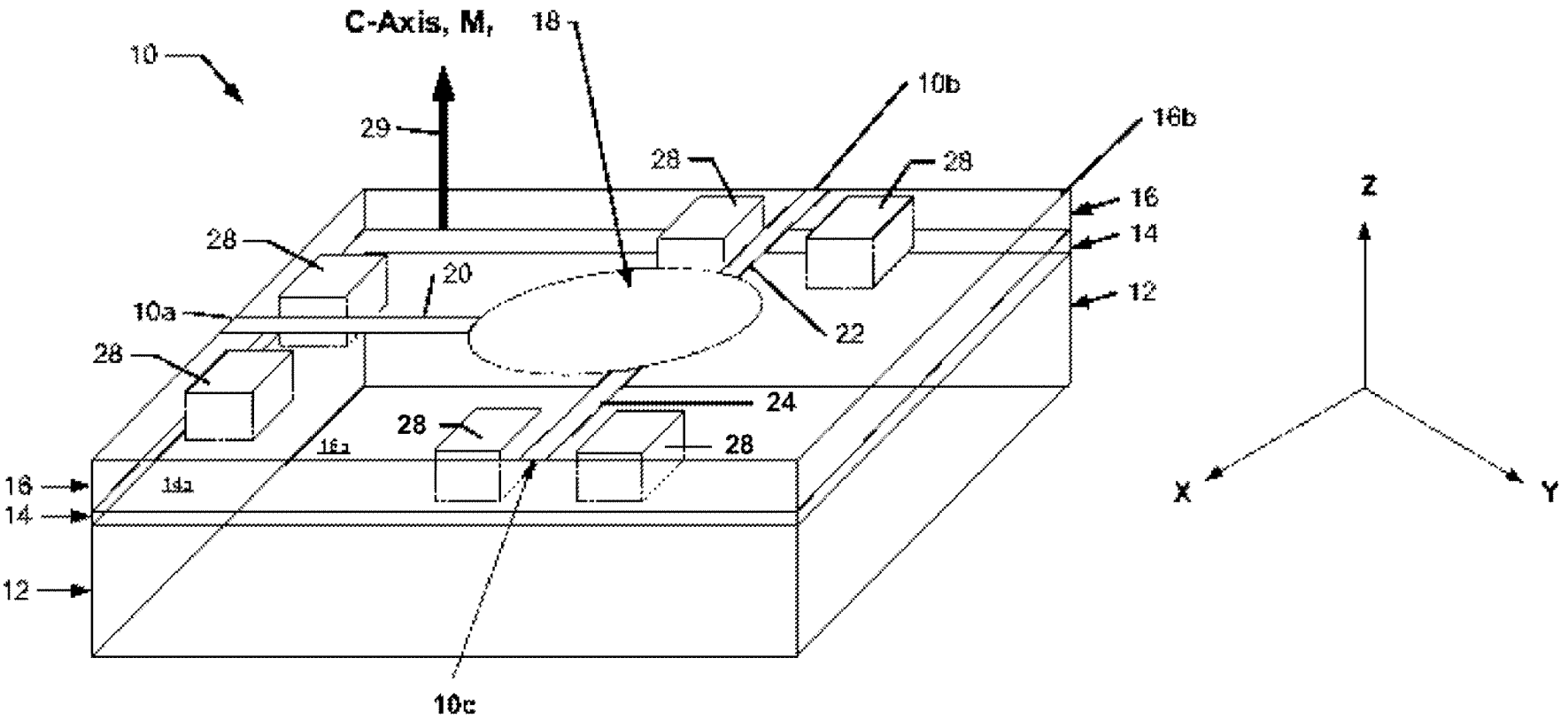
FIG. 1 is an isometric view of a self-biased circulator.

Before proceeding with a discussion of the concepts, systems, device, circuits and techniques described herein, some introductory concepts and terminology are first provided.

Various embodiments of the concepts, systems, and techniques are described herein with reference to the related drawings. Alternative embodiments can be devised without departing from the scope of the described concepts. It is noted that various connections and positional relationships (e.g., over, below, adjacent, etc.) are set forth between elements in the following description and in the drawings. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship. As an example of an indirect positional relationship, references in the present description to element or structure "A" over element or structure "B" include situations in which one or more intermediate elements or structures (e.g., element "C") is between element "A" and element "B" regardless of whether the characteristics and functionalities of element "A" and element "B" are substantially changed by the intermediate element(s).

The following definitions and abbreviations are to be used for the interpretation of the claims and the specification.

As used herein, the terms "comprises," "comprising," "includes," "including," "has," "having," "contains" or "containing," or any other variation thereof, are intended to cover a non-exclusive inclusion. For example, a method, article, or apparatus that comprises a list of elements is not necessarily limited to only those elements but can include other elements not expressly listed or inherent to such method, article, or apparatus.

Additionally, the term "exemplary" is used herein to mean "serving as an example, instance, or illustration." Any embodiment or design described herein as "exemplary" is not necessarily to be construed as preferred or advantageous over other embodiments or designs. The terms "one or more" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection".

References in the specification to "one embodiment," "an embodiment," "an example embodiment," or variants of such phrases indicate that the embodiment described can include a particular feature, structure, or characteristic, but every embodiment can include the particular feature, structure, or characteristic. Moreover, such phrases are not necessarily referring to the same embodiment. Further, when a particular feature, structure, or characteristic is described in connection knowledge of one skilled in the art to affect such feature, structure, or characteristic in connection with other embodiments whether or not explicitly described.

Furthermore, it should be appreciated that relative, directional or reference terms (e.g. such as "above," "below," "left," "right," "top," "bottom," "vertical," "horizontal," "front," "back," "rearward," "forward," etc.) and derivatives thereof are used only to promote clarity in the description of the figures. Such terms are not intended as, and should not be construed as, limiting. Such terms may simply be used to facilitate discussion of the drawings and may be used, where applicable, to promote clarity of description when dealing with relative relationships, particularly with respect to the illustrated embodiments. Such terms are not, however, intended to imply absolute relationships, positions, and/or orientations. For example, with respect to an object or structure, an "upper" surface can become a "lower" surface simply by turning the object over. Nevertheless, it is still the same surface and the object remains the same. Also, as used herein, "and/or" means "and" or "or", as well as "and" and "or." Moreover, all patent and non-patent literature cited herein is hereby incorporated by references in its entirety.

The terms "disposed over," "overlying," "atop," "on top," "positioned on" or "positioned atop" mean that a first element, such as a first structure, is present on a second element, such as a second structure, where intervening elements or structures (such as an interface structure) may or may not be present between the first element and the second element. The term "direct contact" means that a first element, such as a first structure, and a second element, such as a second structure, are connected without any intermediary elements or structures between the interface of the two elements.

The concepts described herein relate to the use of one layer provided from a ferrite material or permanent magnet material (referred to herein as a compensating layer) that is both electrically de-coupled from a circulator junction circuit and magnetically coupled to a second ferrite layer (referred to herein as an active circulator layer).

Referring now to FIG. 1, a self-biased circulator 10 (aka the "device") having ports 10*a*, 10*b*, 10*c* includes a first substrate 12 having first and second opposing surfaces 12*a*, 12*b*. An RF ground plane 14 is disposed over surface 12*b* and a second substrate 16 having first and second opposing surfaces 16*a*, 16*n* is disposed over the ground plane. For reasons which will become apparent from the description herein below, substrate 12 is sometimes referred to herein as a "compensating substrate" or a "compensating layer" and second substrate 16 is sometimes referred to herein as an "active substrate" or an "active layer." A circulator junction circuit 18 (or more simply "junction circuit 18") is disposed over surface 16*b* of active layer and signal paths 20, 22, 24 (also sometimes referred to as signal conductors 20, 22, 24 or signal traces 20, 22, 24) couple signals from junction circuit 18 to respective ones of circulator ports 10*a*, 10*b*, 10*c*. In embodiments, compensating layer may be in direct contact with at least portions of the RF ground plane and may also be in direct contact with portions of the active layer. In other embodiments, intervening layers may exist between some or all of the compensating layer and the RF ground plane and/or between some or all of the compensating layer and the active layer.

Self-biased circulator 10 further comprises ground signal paths 28 disposed about signal paths 20, 22, 24. A first end of ground signal paths 28 is disposed on surface 16*b* of active layer 16 and a second end of ground signal paths 28 is coupled to RF ground plane 14. In this illustrative example, ground signal paths 28 are provided as ground vias which extent through active layer 16 and are coupled to surface 14*b* of RF ground plane 14.

Thus, in the example embodiment of FIG. 1, the active layer 16 is disposed between RF ground plane 14 and a circulator junction circuit 18 and the circulator junction circuit is disposed on or otherwise provided on a top surface of the active layer 16 (which, in embodiments, may also be the top surface of the device). In embodiments, the circulator junction may be disposed directly on the top surface of the active layer. The RF ground plane is disposed between the active layer and a compensating layer.

The active layer and compensating layer are used in combination to reduce (and ideally, minimize) variation of the internal magnetic field in the ferrite over temperature.

In some embodiments compensating layer 12 may be provided from a ferrite material (and thus may be referred to as a ferrite layer). In some embodiments, the compensating layer may be provided from a non-ferrite material. Regardless of whether the compensating layer comprises a ferrite material, a non-ferrite material or a combination of ferrite and non-ferrite materials, the compensating layer may have the characteristics of a permanent magnet. Thus, in some embodiments, the compensating layer may comprise one or more of: $BaFe_{12}O_{19}$ Hexaferrite, NdFeB Neodymium Iron Boron, SmCo Samarium Cobalt, AlNiCo AKA Alnico magnets or Ni—Fe temperature compensating alloys. Other materials may also be used. In short, any permanent magnet material having suitable magnetic strength and shape for the particular application may be used. The RF ground plane electrically de-couples the compensating layer from the circulator junction circuit. The compensating layer is, however, magnetically coupled to the active layer.

In embodiments, the active layer and compensating layer comprise hexaferrite. In embodiments, two or more layers may be used. For example, either or both of the active and compensating layers may comprise a multi-layer substrate.

In embodiments, the RF ground plane and the circulator junction are comprised of electrically conductive materials (e.g., a metal such as copper or gold may be used).

In the equation below, a lower value of the demagnetization factor N means the contribution of the equilibrium magnetic moment Mr 29 is smaller, so the magnitude of the internal field is higher.

$$H_{internal}=H_{external}+H_{anisotropy}(N\times M_r)$$

in which:

$H_{internal}$ is an internal magnetic field of the self-biased ferrite;

$H_{anisotropy}$ is a magneto-crystalline anisotropy field of the self-biased ferrite;

N is a demagnetization factor normal to the plane of the circulator circuit and parallel to the easy axis of the self-biased ferrite; See Appendix 1 for a derivation of N.

Mr is a residual magnetic moment; and $H_{applied}$ is an externally applied magnetic field which is sometimes 0 in the case of a self-biased circulator.

Inserting the compensating layer below the active layer's ground plane reduces the magnitude of the demagnetization factor N (where the demagnetization factor is a number between 0 and 1). In accordance with the concepts described herein, it has been recognized that there is concomitant relationship between the thickness of the compensating layer and the amplitude of the demagnetization factor N. In particular, the thicker the compensating layer, the lower N can become. For self-biased circulators operating in the Ka band frequency range (i.e., the range of 26 to 40 GHz) with a nominal active layer thickness of 0.1 mm, diameter-to-thickness ratio in the range of 8:1 to 20:1, demagnetizing factor in the range of 0.77 to 0.88, permeance coefficient in the range of 0.30 to 0.14, it is desirable to utilize compensator layers that would change the diameter-to-thickness ratio to 6:1 or better, e.g., 4:1. For example, a 0.1 mm active layer with diameter of 1.5 mm (i.e., a diameter-to-thickness ratio=15:1) would require a compensation layer of at least 0.15 mm to change the diameter-to-thickness ratio to 6:1. The degree to which the diameter-to-thickness ratio needs to be changed depends upon the minimum storage or operating temperature, whichever is lower, for the self-biased circulator. The lower the temperature, the better (closer to 1:1) the diameter-to-thickness ratio needs to be, after the addition of the compensating layers. Reducing N has at least the following effects: (1) at room temperature, for a given material, the internal field increases because N is reduced (and in some embodiments, is minimized); (2) in the range of +25 to +150 degrees Celsius, since Mr reduced, the internal field increases, but the increase of the internal field is limited by the fact that N is reduced or minimized; (3) in the range of −55 to +25 degrees Celsius, since Mr increases, the internal field decreases, but the decrease of the internal field is limited by the fact that N is reduced or minimized.

Since the compensating layer changes the N parameter, it also changes the $P_c$ parameter. With a higher $P_c$ the device can be exposed to lower storage temperatures without experiencing permanent demagnetization. Thus, the structure described herein enables thin active layers used in circulator devices to be exposed to very low storage temperature, that would otherwise cause permanent demagnetization damage to the device.

Although FIG. 1 illustrates a microstrip configuration, the structure of active and compensating layers described does not affect the magneto-crystalline anisotropy field. Thus, the concepts described herein can be applied to any type of microstrip, stripline or coplanar waveguide circuit.

In the case of a microstrip circuit, the compensating layer can be placed below the RF ground plane as illustrated in FIG. 1.

In the case of stripline circuits, the compensating layer could be placed above and/or below the ground planes.

The concepts described herein may be applied to any device having any circulator junction shape including but not limited to any regular geometric shape including but not limited to circular, triangular, or any known or unknown circulator junction shape.

Furthermore, in embodiments, a radiation shield may be used to reduce, and ideally minimize losses. For example, in microstrip embodiments, the radiation shield may be provided from a conductive material electrically coupled to the device ground plan and disposed above the circulator junction circuit. In embodiments, the radiation shield may comprise a highly electrically conductive material which is well grounded, and positioned a few milli-meters above the circulator junction circuit.

In stripline embodiments, ground planes of the stripline circuit provides a natural radiation shield, so use of an external shield would provide additional shielding.

Figure 2:
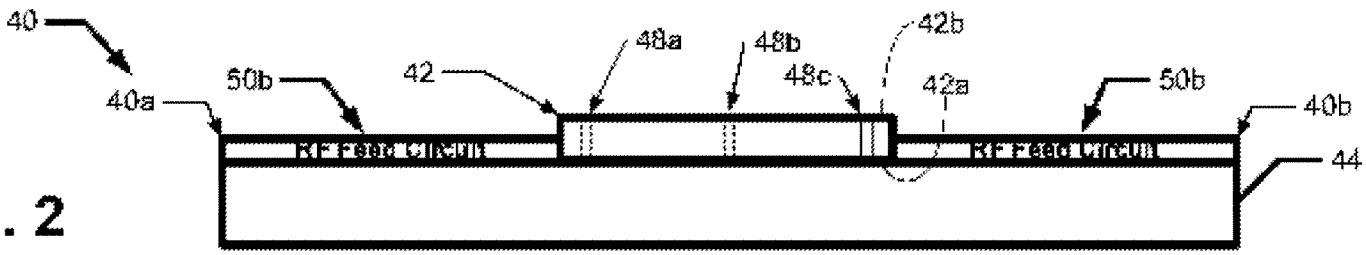
FIG. 2 is a side view of a self-biased circulator.
Figure 2A:
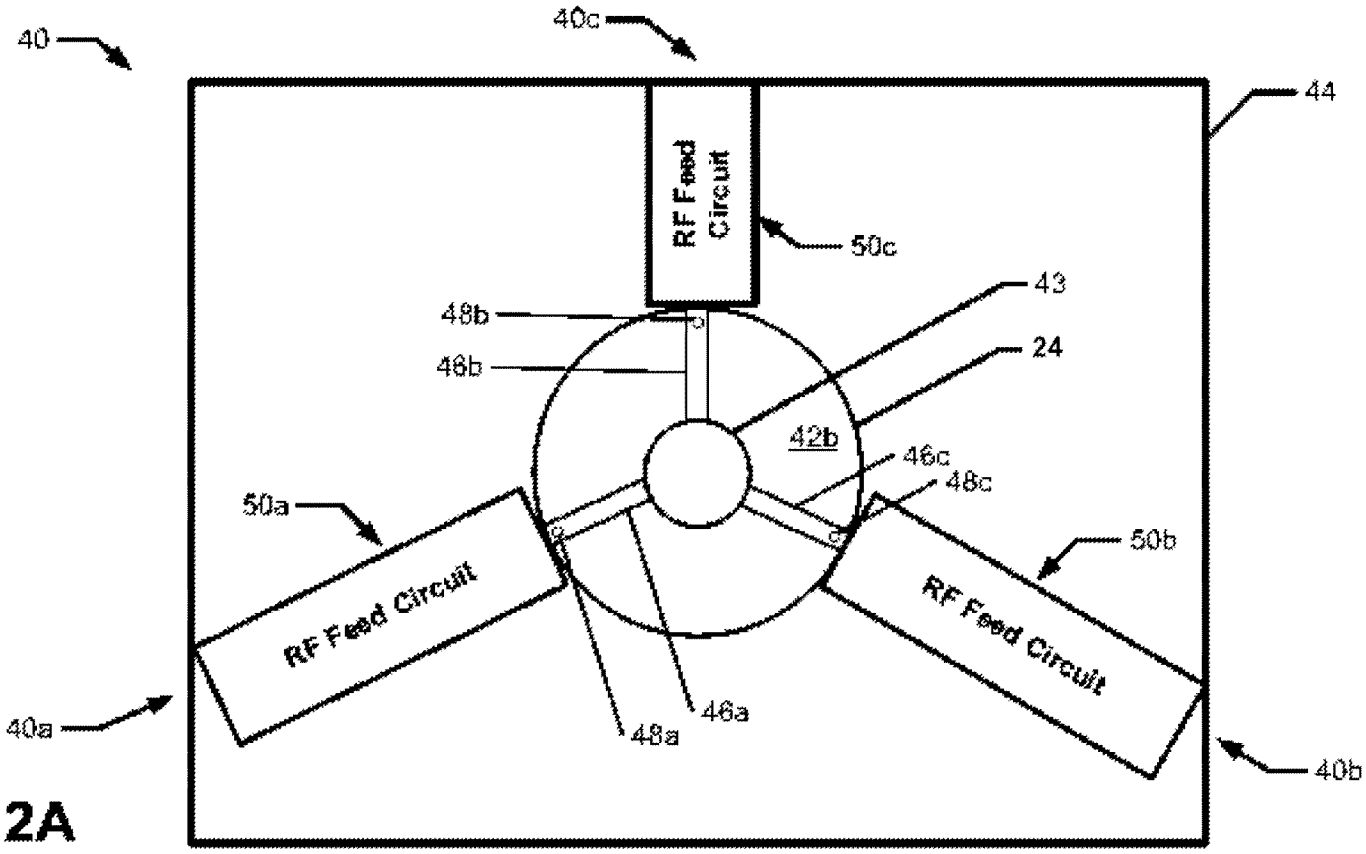
FIG. 2A is a top view of the self-biased circulator of FIG. 2.

Referring now to FIGS. 2 and 2A in which like elements are provided having like reference designations, a circulator 40 comprises a self-biased circulator circuit 42 disposed on a substrate 44. Substrate 44 may be provided from a printed circuit board material including but not limited to a synthetic resin bonded material or a glass reinforced epoxy laminate material (e.g. any of the FR1-FR6 or G10 materials) or a metal core board or insulated metal substrate. Or substrate 44 may comprise a polyimide material or may comprise polytetrafluoroethylene (PTFE) or may comprise alumina. Substrate 44 may also comprise a semiconductor material such as gallium arsenide (GaAs) or other Group III-V materials or any material appropriate for use with MMICs.

Self-biased circulator circuit 42 may be provided as an integrated circuit (e.g. a MMIC) and thus is sometime referred to as a "junction chip 42." Junction chip 42 comprises a compensating layer and an active layer which may be the same as or similar to compensating layer 12 and active layers 16 described above in conjunction with FIG. 1.

A circulator junction circuit 43 (or more simply "junction circuit 43") (most clearly see in FIG. 2A) is disposed over a surface of the active layer and signal paths 46*a*, 46*b*, 46*c* (FIG. 2A) couple signals from junction circuit 43 to respective ones of circulator ports 40*a*, 40*b*, 40*c* (FIG. 2A) which are coupled to respective ones of RF circuits 50*a*-50*c* which may be any type of RF circuits. For example one or more or RF circuits 50*a*-50*c* may comprise a quarter-wave transformer or may comprise circuitry leading to or from RF transmit and/or RF receive circuitry of an RF system.

Junction chip 42 further comprises ground signal paths (here illustrated as ground vias 48*a*-48*c*) disposed in respective ones of signal paths 46*a*-46*c*. A first end of ground vias 48*a*-48*c* is coupled to a respective one of signal paths 46*a*-46*c* and a second end of ground vias 48*a*-48*c* to RF ground plane 43. Thus, in this illustrative example, ground vias extend through an active layer of substrate 44 and are coupled to RF ground plane 43.

Thus, in the example embodiment of FIGS. 2, 2A, the active layer is disposed between an RF ground plane and a circulator junction circuit and the circulator junction circuit is disposed on or otherwise provided on a top surface of an active layer (which, in embodiments, may also be the top surface of the device). In embodiments, the circulator junction may be disposed directly on the top surface of the active layer. The RF ground plane is disposed between the active layer and a compensating layer.

The active layer and compensating layer are used in combination to reduce (and ideally, minimize) variation of the internal magnetic field in the ferrite over temperature.

In some embodiments compensating layer may be provided from a ferrite material (and thus may be referred to as a ferrite layer). In some embodiments, the compensating layer may be provided from a non-ferrite material. Regardless of whether the compensating layer comprises a ferrite material, a non-ferrite material or a combination of ferrite and non-ferrite materials, the compensating layer may have the characteristics of a permanent magnet. Thus, in some embodiments, the compensating layer may comprise one or more of: $BaFe_{12}O_{19}$ Hexaferrite, NdFeB Neodymium Iron Boron, SmCo Samarium Cobalt, AlNiCo AKA Alnico magnets or Ni—Fe temperature compensating alloys. Other materials may also be used. In short, any permanent magnet material having suitable magnetic strength and shape for the particular application may be used. The RF ground plane electrically de-couples the compensating layer from the circulator junction circuit. The compensating layer is, however, magnetically coupled to the active layer.

In embodiments, the active layer and compensating layer may comprise hexaferrite. In embodiments, two or more layers may be used. For example, either or both of the active and compensating layers may comprise a multi-layer substrate.

In embodiments, the RF ground plane and the circulator junction are comprised of electrically conductive materials (e.g., a metal such as copper or gold may be used).

RF feed circuits 50*a*-50*c* are coupled to respective ones of circular signal paths 46*a*-46*c*.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

The terms "approximately" and "about" may be used to mean within ±20% of a target value in some embodiments, within ±10% of a target value in some embodiments, within ±5% of a target value in some embodiments, and yet within ±2% of a target value in some embodiments. The terms "approximately" and "about" may include the target value. The term "substantially equal" may be used to refer to values that are within ±20% of one another in some embodiments, within ±10% of one another in some embodiments, within ±5% of one another in some embodiments, and yet within ±2% of one another in some embodiments.

The term "substantially" may be used to refer to values that are within ±20% of a comparative measure in some embodiments, within ±10% in some embodiments, within ±5% in some embodiments, and yet within ±2% in some embodiments. For example, a first direction that is "substantially" perpendicular to a second direction may refer to a first direction that is within ±20% of making a 90° angle with the second direction in some embodiments, within ±10% of making a 90° angle with the second direction in some embodiments, within ±5% of making a 90° angle with the second direction in some embodiments, and yet within ±2% of making a 90° angle with the second direction in some embodiments.

It is to be understood that the disclosed subject matter is not limited in its application to the details of construction and to the arrangements of the components set forth in the following description or illustrated in the drawings. The disclosed subject matter is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the disclosed subject matter. Therefore, the claims should be regarded as including such equivalent constructions insofar as they do not depart from the spirit and scope of the disclosed subject matter.

Although the disclosed subject matter has been described and illustrated in the foregoing exemplary embodiments, it is understood that the present disclosure has been made only by way of example, and that numerous changes in the details of implementation of the disclosed subject matter may be made without departing from the spirit and scope of the disclosed subject matter.

What is claimed is:

1. A self-biased circulator having first, second and third ports, the self-biased circulator comprising:

a compensating layer having a top surface and a bottom surface, wherein the compensating layer comprises a permanent magnet material having a magnetic moment Mr which is perpendicular to a plane in which the compensating layer lies;

an active layer having a bottom surface disposed over the top surface of the compensating layer and a top surface;

a first RF ground plane layer disposed between the top surface of the compensating layer and the bottom surface of the active layer; and a circulator junction circuit disposed on the top surface of the active layer and electrically coupled to the first, second and third ports of the self-biased circulator.

2. The self-biased circulator of claim 1 further comprising one or more RF ground vias extending from the top surface of the active layer to a first surface of the first RF ground plane layer.

3. The self-biased circulator of claim 1 wherein the circulator junction circuit is provided having a regular geometric shape.

4. The self-biased circulator of claim 3 wherein the circulator junction circuit is provided having one of: a circular shape; and a triangular shape.

5. The self-biased circulator of claim 1 wherein the circulator junction circuit is provided as a microstrip circuit.

6. The self-biased circulator of claim 5 wherein the compensating layer is disposed below the first RF ground plane layer.

7. The self-biased circulator of claim 5 further comprising a radiation shield disposed above the circulator junction circuit.

8. The self-biased circulator of claim 7 wherein the radiation shield comprises an electrically conductive material disposed above the circulator junction circuit and is electrically coupled to the RF ground plane layer.

9. The self-biased circulator of claim 1 wherein the RF ground plane layer is a first RF ground plane layer and the self-biased circulator further comprises a second RF ground plane layer disposed above the first second and third ports of the self-biased circulator such that the circulator junction circuit is provided as a stripline circuit.

10. The self-biased circulator of claim 9 wherein the compensating layer is disposed below the first RF ground plane layer.

11. The self-biased circulator of claim 9 wherein the compensating layer additionally includes a layer disposed above the second RF ground plane layer.

12. A self-biased circulator comprising:

a compensating layer having first and second opposing surfaces, wherein the compensating layer comprises a permanent magnet material having a magnetic moment Mr which is perpendicular to a plane in which the compensating layer lies;

an RF ground plane layer disposed over a first one of the first and second surfaces of the compensating layer;

an active layer having first and second opposing surfaces with a first one of the first and second surfaces disposed over the RF ground plane layer; and a circulator junction disposed on a second one of the first and second surfaces of the active layer wherein the circulator junction is provided as one of:

a microstrip circuit; and a stripline circuit.

13. The self-biased circulator of claim 12 wherein the compensating layer comprises a ferrite material.

14. The self-biased circulator of claim 12 wherein the compensating layer comprises a non-ferrite material.

15. The self-biased circulator of claim 12 wherein the compensating layer comprises at least one of:

a Hexaferrite ($BaFe_{12}O_{19}$);

Neodymium Iron Boron (NdFeB);

Samarium Cobalt (SmCo);

a magnet comprising Alnico; or a nickel-iron (Ni—Fe) temperature compensating alloy.

16. A self-biased circulator having first, second and third ports, the self-biased circulator comprising:

a compensating layer having first and second opposing surfaces, the compensating layer comprising a permanent magnet material having a magnetic moment Mr which is perpendicular to a plane in which the compensating layer lies;

an RF ground plane layer having a first surface disposed over the second surface of the compensating layer and having a second opposing surface;

an active layer having a first surface disposed over the second surface of the RF ground plane layer and a second opposing surface wherein the active layer is magnetically coupled to the compensating layer;

a circulator junction circuit disposed over the second surface of the active layer and electrically coupled to the first, second and third ports of the self-biased circulator.

17. The self-biased circulator of claim 16 wherein the active layer comprises a hard ferrite having a magnetic moment Mr which is perpendicular to a plane in which the compensating layer lies.

18. The self-biased circulator of claim 17 wherein the compensating layer comprises a ferrite material.

19. The self-biased circulator of claim 17 wherein the compensating layer comprises a non-ferrite material.

20. The self-biased circulator of claim 17 wherein the compensating layer comprises at least one of:

a Hexaferrite ($BaFe_{12}O_{19}$);

Neodymium Iron Boron (NdFeB);

Samarium Cobalt (SmCo);

a magnet comprising Alnico; or a nickel-iron (Ni—Fe) temperature compensating alloy.

* * * * *